US005379878A

United States Patent [19]

Rohde

[11] Patent Number: 5,379,878

[45] Date of Patent: Jan. 10, 1995

[54] TWO-WAY GATHERER

[76] Inventor: Jason A. Rohde, Star Rte., Box 75, Maurertown, Va. 22644

[21] Appl. No.: 175,540

[22] Filed: Dec. 30, 1993

[51] Int. Cl.[6] ..... B65G 37/00

[52] U.S. Cl. ..... 198/366; 198/370; 198/371; 198/615

[58] Field of Search ..... 198/366, 370, 371, 583, 198/584, 615, 812

[56] References Cited

U.S. PATENT DOCUMENTS 4,245,738 1/1981 Butcher et al. ..... 198/812
4,429,517 2/1984 Lohrentz et al. ..... 198/370
5,316,125 5/1994 Matsushima et al. ..... 198/583
5,322,154 6/1994 Lenherr ..... 198/812

*Primary Examiner*—Joseph E. Valenza
*Attorney, Agent, or Firm*—Terrance L. Siemens

[57] ABSTRACT

An improved apparatus and method of converting power conveyors for improving the efficiency and usage factor of machines located along a line fed by such conveyors. In some systems such as assembling and forming signatures for binding into magazines, all the machines along the line are not required for all the jobs. Efficiency and equipment utilization is improved by transforming the existing power conveyer into two power conveyers, going in opposite directions and simultaneously feeding a portion of the machines for each of two jobs not requiring all the machines on the line.

6 Claims, 2 Drawing Sheets

TWO-WAY GATHERER

BACKGROUND OF THE INVENTION

1. Field of the Invention

The present invention relates to flexible manufacturing systems using power conveyors to transport work between multiple work locations. More specifically, it relates to an improved apparatus and method of converting the power conveyors for improving the efficiency and usage factor of the machines located along a line in such a system. Such lines of machines, known generally as "production" or "assembly" lines, are old and well known and are used in many industries for improving efficiencies. By providing a means for converting a single long feed conveyor into two, oppositely running, feed conveyors, a larger portion of the machinery along such a line can be utilized simultaneously. It should be understood from the outset that the term "production line" as used herein is not necessarily confined to a straight line. Machines on such a production line are often arranged to go around corners or even arranged in curved patterns or circles. The word "line", in accordance with common terminology in this context, is applicable only in the sense that work proceeds sequentially from one machine to the next along the path of machinery.

This invention can be used in any industry in which sequential steps are used to produce or assemble a final product and a power conveyor can be used to carry the product from a location for performing one step to a location for performing the next step. Particularly large benefits can accrue in certain fields where each successive step is capable of being performed by similar or identical machinery and where that machinery is complex and expensive. Industries such as the the binding or "stitching" segment of the publishing industry are of such a nature. Because of the large potential savings, this industry has been chosen for the exposition of a preferred embodiment of the invention to follow.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

Collating and binding systems are well known in the printing industry for mass producing booklets, magazines, catalogues, advertising brochures and the like. Typically, one or more sharply folded and generally pre-printed blanks or signatures (packets of individual sheets) are sequentially fed by a number of signature feeders. The signatures are delivered such that the signatures come to rest upon a collating conveyor line which travels past the signature feeders. The conveyor gathers the signatures, one atop another, and moves them to a binding, stitching, or stapling station. The assembled signatures then are usually diverted to a trimming station and further led to a labeling station where mailing labels are affixed.

Prior art systems of this type contemplate the computer controlled production of various demographic editions of books or catalogues of internal and external (cover) signatures containing individually tailored information or customized printing on selected signatures. This flexibility is important in satisfying the demands of a particular market or geographical destination. For instance, it may be desirable to offer certain customers or subscribers various features or selected advertising depending upon their special interest, income, or occupation. Likewise it may be relevant to customize products or services contingent upon a customer's previous buying history. As an example, a publication may issue one demographic edition for parents of newborn children who have purchased baby products, another edition for farmers interesed in the latest milking machines, and still another edition for fitness buffs who have ordered exercise equipment.

Machinery has even been developed which has redundant conveyors so as to feed signatures (packets of individual sheets) from an alternate source in case of malfunction in the primary source. The complex signature feeding machinery needed for such flexible binding jobs is very expensive with each station costing in excess of $30,000.

Devices for conveying work from one work station to the next are old and well known in the bookbinding art. Recently, technological advances in high speed printing have made it possible to print tremendous quantities of high quality printed sheets very rapidly. This in turn has led to the development of expensive, highly specialized machinery to form those sheets of printed matter into useful and saleable publications such as booklets and magazines as discussed above.

The following known prior art has been directed to providing some sort of conveyor apparatus for transporting printed matter to or from machinery used in the art of bookbinding. None of this prior art has taught the concept of providing flexibility to the bookbinding process by converting the conveyor apparatus so as to feed different machines nor so as to run in different directions. As will be seen, the simplicity and effectiveness of my invention is not rivaled in the prior art.

U.S. Pat. No. 5,232,324, issued to Graushar on Aug. 3, 1993, shows an apparatus and method for applying covers to books of signatures transported along a binding line. The apparatus includes cover feeders for feeding at least two covers upon a conveyor line and a fastening arrangement for joining the covers in substantially superimposed registration on the signatures at a covering station on the binding line. A spacer bar is supported on the conveyor line for temporarily separating the covers before they are joined to the signatures. The apparatus does not contemplate modification of the conveying means for different jobs as is shown by the instant invention.

U.S. Pat. No. 4,653,972, issued to Lewis on Mar. 31, 1987, shows a bookbinding machine which includes an advancing track of chain, a plurality of book clamps drivable by the chain successively to one or more processing stations, and means for arresting the movement of some of the clamps at some of the stations, while the other clamps remain in motion. By contrast, the device of the instant invention modifies the conveying means for different jobs.

U.S. Pat. No. 5,087,163, issued to Erbdories et al. on Feb. 11, 1992, shows a press for stitching book block sections which employs a transport system for transporting book sections to a stitching station. Carriages are mounted to an endless conveyor. A saddle is pivotally mounted to each of the carriages. The book sections are received on the saddle and transported to the stitching station in a continuous fashion. The pivotal swing of the saddles is controlled by rollers engaging cam paths as the conveyor is circulated. By contrast, the device of the instant invention modifies the conveying means for different jobs.

U.S. Pat. No. 4,704,973, issued to Horst on Nov. 10, 1987, shows a sewing press for thread-sewing book blocks which are formed from individual book block sections comprising an endless conveyor which transports the block sections into registration with a sewing head. The conveyor includes sewing saddles which support the block sections during sewing, the saddles being articulated to a continuously moving chain so as to have a dwell phase in the sewing region. The sewing needles, after punching the sewing thread through the block section, pivot to directly transfer the thread to the cooperating hook needles which, in turn, draw the thread back through the block section in the form of a loop which is linked to a loop on the preceding block section. By contrast, the device of the instant invention is not concerned with the details of a stitching or stapling operation and discloses a novel method of converting the power conveyor for use with different sized jobs.

U.S. Pat. No. 2,024,959, issued to Alger on Dec. 17, 1935, shows a bookbinding machine fed by a chain conveyor means operating with an intermittent movement. The chain is supported on and driven by sprockets as contemplated by my invention. The chain extends lengthwise of the machine and is provided, at intervals, with upstanding feeding lugs similar to those used by my invention. The feeding lugs act to insure proper guidance of the books. By contrast, the instant invention includes means to modify the chain conveyor and its driving mechanism so as to separately feed two lines of machines in opposite directions or, alternately, so as to feed a single line of machines in a single direction.

None of the above inventions and patents, taken either singly or in combination, is seen to describe the instant invention as claimed.

SUMMARY OF THE INVENTION

Briefly, the invention comprises conveyor conversion system. This invention is concerned with improving the machinery that has been developed to arrange, collate, and bind sheets of printed matter into useful readable articles such as magazines, pamphlets, and booklets. In accordance with conventional terminology, the term bookbinding used herein may be taken to mean the collecting together of multiple sheets of printed matter in paged sequence and the subsequent fastening of those sheets to one another, folding, trimming, and labeling so as to form a completed magazine or booklet ready for mailing.

Accordingly, it is a principal object of the invention to provide a new and improved two-way gathering chain which overcomes the disadvantages of the prior art in a simple but effective manner.

It is a major object of this invention to provide a method and apparatus which is capable of use with many sorts of lines of machines or workers which are performing similar operations on a product in a sequential manner.

It is a more specific object of this invention to provide an apparatus and method for converting the gathering chain on an existing line of signature feeders into a dual chain feeding the same line of signature feeders but in opposite directions from a center position outward in two directions.

It is another object of the invention to provide a method and apparatus for insuring maximum utilization of as many signature feeders as may be available in a flexible fashion which is adaptable to various sized bookbinding or stitching operations.

It is another object of the invention to provide a bookbinding or stitching operation which can double the productivity of a bindery with little or no further investment in capital equipment.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
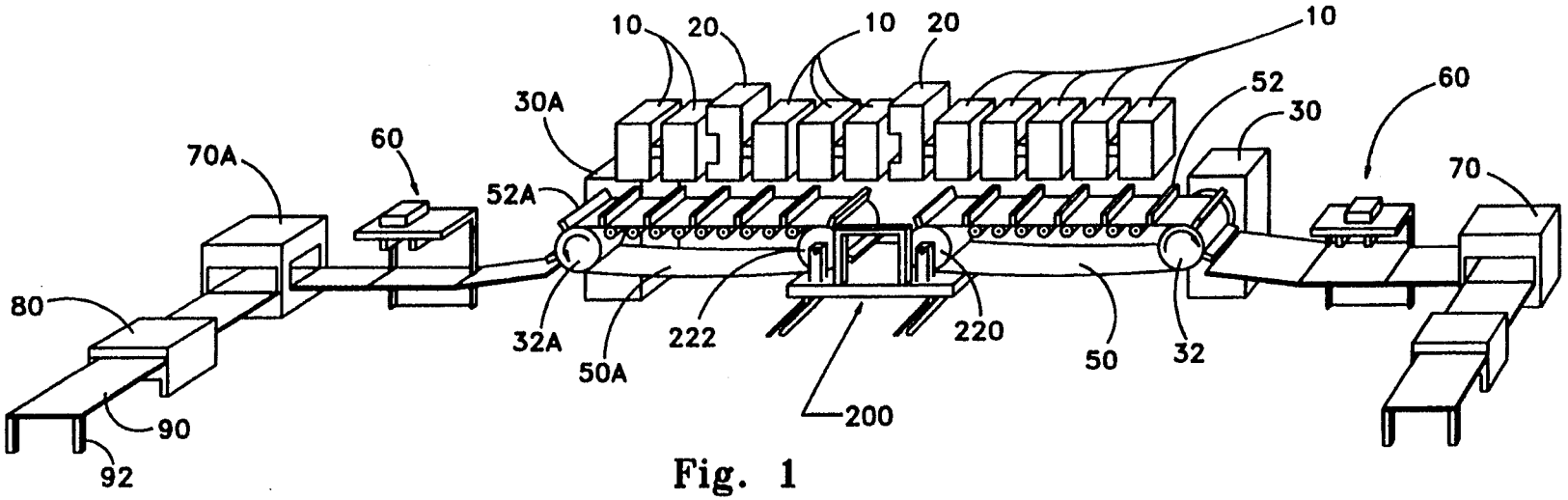
FIG. 1 is an environmental perspective view, shown somewhat schematically, of a stitching line as it would appear after conversion to a dual line with the invention.
Figure 2:
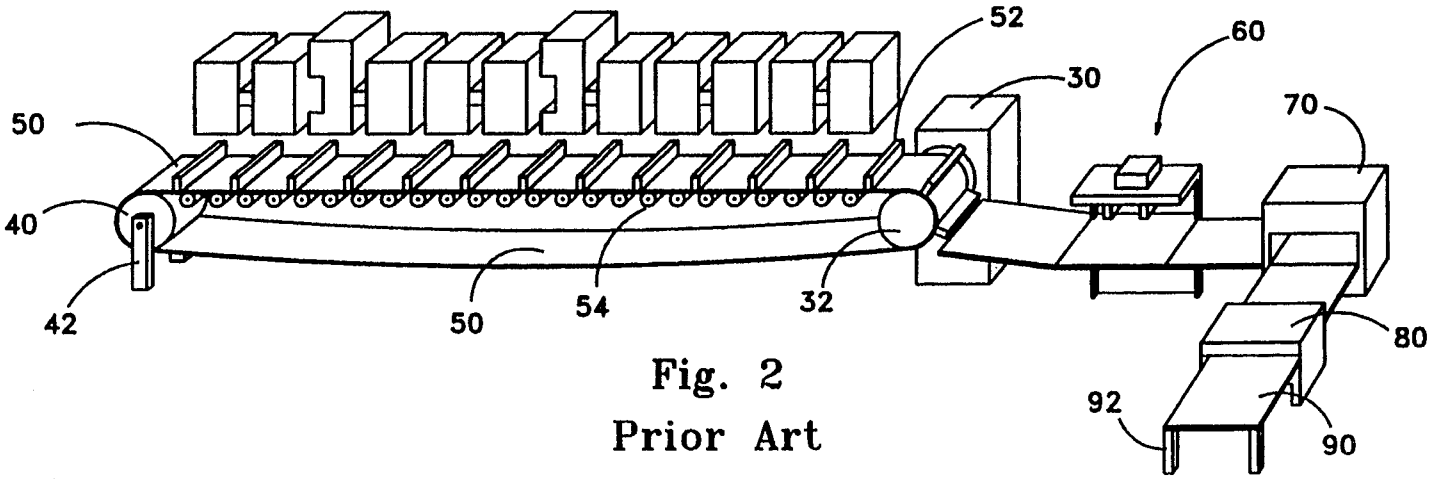
Fig. 2 Prior Art
FIG. 2 is an environmental perspective view, shown somewhat schematically, of a stitching line, as is presently known, labeled as prior art.

The overall environment of the present invention is generally shown in FIG. 1 with the prior art being easily contrasted by reference to FIG. 2 on the same sheet. The primary new apparatus provided by this invention is designated generally by 200 in FIG. 1 which apparatus is shown in more detail in FIGS. 3 and 4. The new apparatus 200, however does not encompass the overall inventive concept. The following description will develop how apparatus 200 is used, in combination with existing elements of the prior art, to form a unique much more efficient arrangement of stitching machinery. Briefly, device 200 comprises the following main parts; idler wheels 220 and 222, support posts 218, main frame 210, wheels 212 and 214, and push handle 211.

Turning first to FIGS. 1 and 2, a description of the prior art arrangement of the stitching line to which this invention can be applied will be given. A plurality of signature feeders or pockets 10 and card feeders 20 are arranged to overlie a gathering chain conveyor 50. The endless chain conveyor is driven by drive sprocket 32 which is rotated by power drive means 30 and is looped around idler sprocket 40 at its other end. The direction of rotation is shown by the arrow on sprocket 32 in FIG. 1. The chain conveyor is divided into intervals by lugs 52 which protrude from the conveying surface and act to push individual items on the surface along. Chain conveyor 50 is shown only schematically here, but it is understood to be of the type with easily exchangable elements, master links, and the like as are all well known in the art.

The pockets 10, which overlie the conveyor intervals, are each complex pieces of equipment. The function of the pockets is to arrange and open individual sheets of printed signatures and to deposit them on successive intervals of gathering chain 50. Card feeders 10 are devices for depositing insert cards, such as reply envelopes and the like on the stack of signatures as they are being built up by this machinery. In practice more than 20 such pockets are arranged to overlie a single conveyor chain.

A brief description of the operation of the stitching line will aid in understanding the particular arrangement of machinery shown. As a simplified example, imagine a 10 page magazine with two card inserts is to be produced by the prior art line of FIG. 2. The leftmost pocket 10 would first deposit the centerfold sheet, comprising the two facing center pages and their reverse sides, on the underlying conveyor interval between two lugs 52. The conveyor chain would then move the center sheet beneath the next pocket 10 where the succeeding sheet (next outward from the center sheet) of printed material would be deposited atop the centerfold sheet. The next pocket comprises a card feeder of the type 20 shown in FIG. 1. The card feeder deposits an insert card atop the previously gathered two sheets. As conveyer 50 continues its rightward travel under the signature feeder pockets and card feeders 20, it can be seen that the entire magazine will eventually be built up page by page.

In reality, as opposed to the simplified example given above, the pockets 10 do not deliver single sheets of printed material but, instead, deposit groups or packets of sheets commonly called signatures. The pockets 10 and card feeders 20 are semi-mobile in the sense that they may be prearranged in any order along the line to satisfy the particular needs of the job at hand. It is also a reality that, although a common form of line in this business has twenty two pockets available, many jobs are run in which ten or fewer pockets are actually put to use. When such a job is run the remaining twelve or more pockets sit idle above the, now excessively long, gathering conveyor and gather dust. This represents a tremendous capital investment in idle machinery. As will be seen the apparatus and method of this invention leads to a significant reduction in this waste.

The last pocket 10 deposits the cover sheet of the magazine on the stack and conveyor 50 then delivers the stack onto another conveyor section leading to stitching machine 60. Although still called a "stitching" machine for historical reasons, machine 60 is usually a complex and expensive stapling machine which staples the stack of sheets together at the center in the manner commonly seen in magazines available on the newstand. The stitching machine represents another large amount of capital investment, although only one is used per bindery line.

Subsequent to the stitching machine 60, the now assembled magazines are passed to a conventional trimmer 70 and an inkjet label machine 90 for printing and applying labels. Other machines (not shown) may be used for such things as stacking, bundling, or packaging the finished magazines or publications.

Now that the overall layout and operation of a typical prior art stitching line has been made clear, we will proceed with a detailed description of my inventive concept and improvement to the operation. Referring specifically to FIG. 1, it can be seen that the original conveyor 50 of the prior art has been divided into two oppositely running conveyors 50, shortened but running as before, and 50A running in the opposite direction. The original long line of pockets 10 and card feeders 20 has been converted into two shorter lines operating simultaneously in opposite directions. To accomplish this, the original idler sprocket 40 of the prior art has been replaced with a driven sprocket 32A powered by drive means 30A. It is contemplated that the new sprocket 32A could be clutched to the new drive means 30A so as to be free wheeling or driven as desired. This would allow a line equipped with the new drive means to operate in a manner identical to that prior to the conversion by simply turning the new drive sprocket into an idler sprocket. The two shorter conveyors feed stitching machines 60, trimming machines 70, 70A and inkjets 80 as before.

The key elements required to turn the original long line conveyor 50 into two oppositely running shorter conveyors are (1) the fact that the chain conveyor is made up of a series of short and replaceable links, (2) the provision of dual idler cart 200, and (3) the replacement of original idler sprocket 40 with clutched power sprocket 32A. The conveyor chains presently in use in this environment are made up of the required short sections of replaceable links and do not need to be described in detail here. The original long chain is separated and refastened to itself to form two chains, each of about half the length of the original. It will be obvious to the artisan that the chain does not have to be evenly divided and, for example, one fourth of the chain, serving about five pockets, could be used on one end and three fourths of the chain, serving about fifteen pockets, could be used on the other end. The actual break point chosen will depend upon the requirements of the two particular binding jobs desired to be run in unison.

Figure 3:
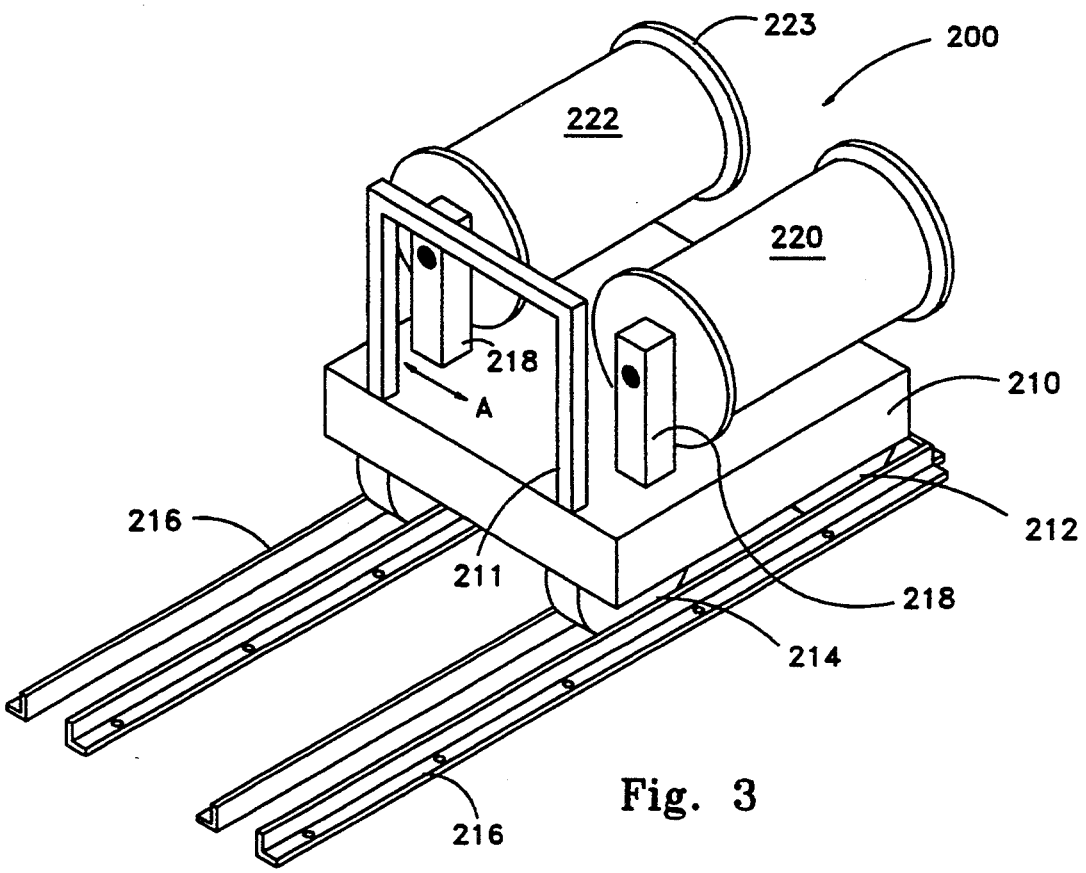
FIG. 3 is an isometric front view, shown somewhat schematically, of the chain conveyor conversion device of the invention.
Figure 4:
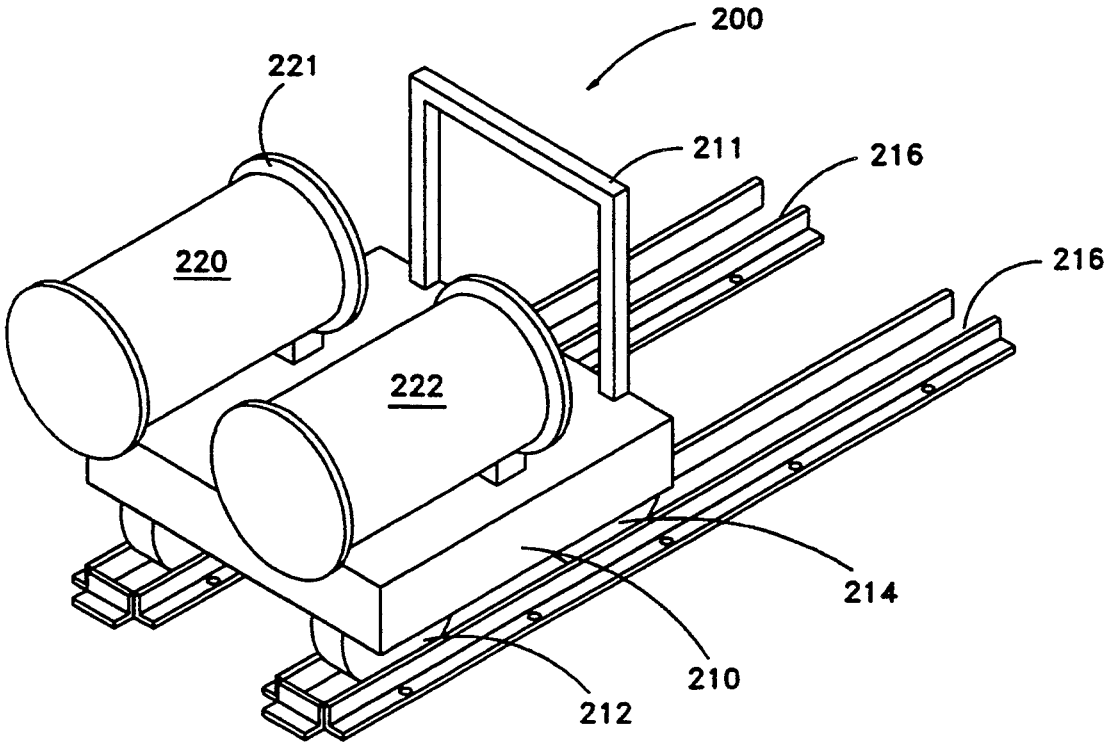
FIG. 4 is is an isometric rear view, of the conversion device of FIG. 3.

Details of the dual idler cart 200 are more clearly seen in FIGS. 3 and 4. Idler sprockets 220 and 222 are supported from a main cart frame 210 by support posts 218. The sprockets are cantilevered from posts 218 so that they may be moved into position in the path of conveyor chain 50 with the minimum of interference with existing support structure (not shown) for the conveyor chain. Cart frame 210 is supported on wheels such as 212, 214 which may be steerable so as to allow easy mobility of the cart during job changeovers. To provide sideways stability to the idler cart during actual operation of the conveyor system, rails 216, firmly attached to the floor, may be used. Additionally, it is contemplated that the wheels may be locked to the rails, as by pins (not shown) during operation, to ensure rigidity and stability of the interposed idler sprockets 220 and 222.

Rim 223 of the sprocket wheels is shown here only schematically as being smooth for simplicity of illustration, but it is to be understood that the actual shape of rim 223 should be complementary to the type of conveyor it supports. For example, if the conveyor is a chain link conveyor, the rim 223 would be formed with sprockets suitable for fitting the conveyor. On the other hand, if the conveyor is a belt conveyor, the rims 223 might be smooth (as shown) and function merely to prevent the belt from riding sideways off the idler wheels 220, 222. Many design variations are possible for the dual idler cart and are intended to be covered by the scope of the claims to this invention.

The advantages of operation of the converted dual power conveyor system should now be obvious. To recap, a final operational example is given. Suppose two binding jobs are presently on hand with one requiring 14 pockets and the other requiring but 6. With a prior art setup, the first job would have to be run with 8 idle pockets before the second job could begin. The second job would then have to be run with 16 idle pockets and the total time for both jobs would be the sum of the times for each job. With the setup of the instant invention, the conveyor would be broken so as to feed past 6 pockets in one direction and 14 pockets in the other direction simultaneously. Total setup time should not be any more than that required for the two separate setups of the prior art system. The jobs could then be run simultaneously so the total job time would not be longer than the run time of the longest of the two jobs. In addition, after the shorter duration job had finished, the other side of the conveyor would be available for setting up and even running a third job while the longer duration job was being completed.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions. For example, the artisan could easily ascertain how to form one of the idler sprockets on the cart as a clutched drive sprocket and thus eliminate the need for a new drive sprocket on the main bindery line. The artisan could also easily see how the floor rails and wheels of the cart could be easily changed to suit the special requirements of a particular job while still satisfying the main requirement of providing stable support for the interposed sprocket wheels.

It is to be understood that the present invention is not limited to the sole embodiment described above, but encompasses any and all embodiments within the scope of the following claims.

I claim:

1. A power conveyor conversion system for an existing powered conveyor which is made up of separable links and which feeds successive machines in an assembly process wherein different jobs require a different number of the machines for completion of the process, said conversion system comprising;

a movable frame containing at least two independent idler wheels complementary with said power conveyer;

a powered drive wheel for replacing an idler wheel of the existing power conveyor, wherein said independent idler wheels are interposed in the existing conveyor chain flight, the links of the existing conveyor are separated and reconnected so as to form a second conveyer in addition to reforming the existing conveyor, and said powered drive wheel is connected to said second conveyor so as to drive it in an opposite direction from the direction of the existing conveyor and so that the reformed existing conveyor feeds a smaller number of the machines in one direction and said second conveyor feeds a smaller number of the machines in the opposite direction.

2. The power conveyor conversion system of claim 1, wherein the existing conveyor is a chain link conveyor and said two independent idler wheels are sprocket wheels which are suitably matched to the chain link conveyor and wherein said powered drive wheel is a powered sprocket wheel which is suitably matched to the chain link conveyor.

3. The power conveyor conversion system of claim 2, wherein said two independent idler sprocket wheels are supported in cantilever fashion from support posts on said movable frame.

4. The power conveyor conversion system of claim 2 wherein said movable frame is supported by wheels and rail means are provided to guide said wheels on a support surface and to lend stability to said two independent idler sprocket wheels.

5. The power conveyor conversion system of claim 1 wherein the machines are signature feeder pockets for sequentially delivering signatures to both the reformed existing conveyor and to said second conveyer.

6. A method of improving the efficiency of a sequence of assembly machines fed by a single endless power conveyor chain with a drive means having a rotating direction comprising the steps of;

providing two adjacent idler wheels compatible with the single power conveyor breaking the single conveyor chain into two separate, shorter, conveyor chain pieces;

wrapping a first of said two separate conveyor chain pieces about one of said two adjacent idler wheels and the existing drive means to form a first, shorter, endless conveyor driven in the same direction;

providing a second drive means rotating in an opposite direction;

wrapping the other of said two separate conveyor chain pieces about the other of said two adjacent idler wheels and said second drive means to form a second endless conveyor driven in the opposite direction;

feeding a portion of the machines the original direction with said first endless conveyor; and feeding the remaining portion of the machines in the opposite direction with said second endless conveyor.

* * * * *